United States Patent [19]

Holt

[11] 3,999,269

[45] Dec. 28, 1976

[54] TERMINATION APPARATUS FOR MAKING SOLDER-LESS ELECTRICAL CONNECTIONS TO CONNECTOR TERMINALS, IN PARTICULAR TO INSULATION-PIERCING TERMINALS

[75] Inventor: Harley Raymond Holt, Hillside, Ill.

[73] Assignee: Bunker Ramo Corporation, Oak Brook, Ill.

[22] Filed: Sept. 23, 1974

[21] Appl. No.: 508,939

Related U.S. Application Data

[63] Continuation of Ser. No. 407,782, Oct. 19, 1973, abandoned.

[52] U.S. Cl. ..... 29/203 MW; 29/203 DT; 29/203 HT

[51] Int. Cl.[2] ..... H01R 43/04

[58] Field of Search ... 29/203 MW, 203 DT, 203 D, 29/203 HT, 203 H, 203 P, 203 R, 628

[56] References Cited

UNITED STATES PATENTS

| | | | |
|---|---|---|---|
| 3,742,571 | 7/1973 | Brehm | 29/203 HT |
| 3,758,935 | 9/1973 | Long et al. | 29/203 MW |
| 3,845,535 | 11/1974 | Over | 29/203 MW |
| 3,866,297 | 2/1975 | Aldridge et al. | 29/203 MW |

*Primary Examiner*—Carl E. Hall
*Attorney, Agent, or Firm*—William Lohff; F. M. Arbuckle

[57] ABSTRACT

In a known type of machine for ordinarily making solder connections, and which includes a conductor separating and holding device, a carriage mounted conductor cutting and end stripping device and a carriage mounted terminal strip holder movable across the carriage for visual and manual alignment with the strip conductors, an improved structure for terminating free-ended insulated conductors in insulation-piercing contacts of an electrical connector provides for the elimination of the wire stripping blade and means for supporting the electrical connector in a predetermined relationship with respect to the separated wires and an insertion tool operatively associated with the support means and in a predetermined alignment with the connector contacts for quickly making mechanical and electrical terminations of the conductors.

20 Claims, 7 Drawing Figures

Fig. 4
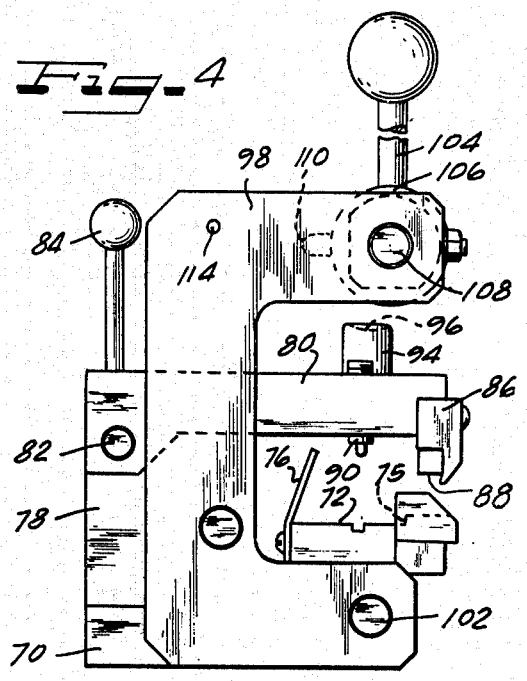
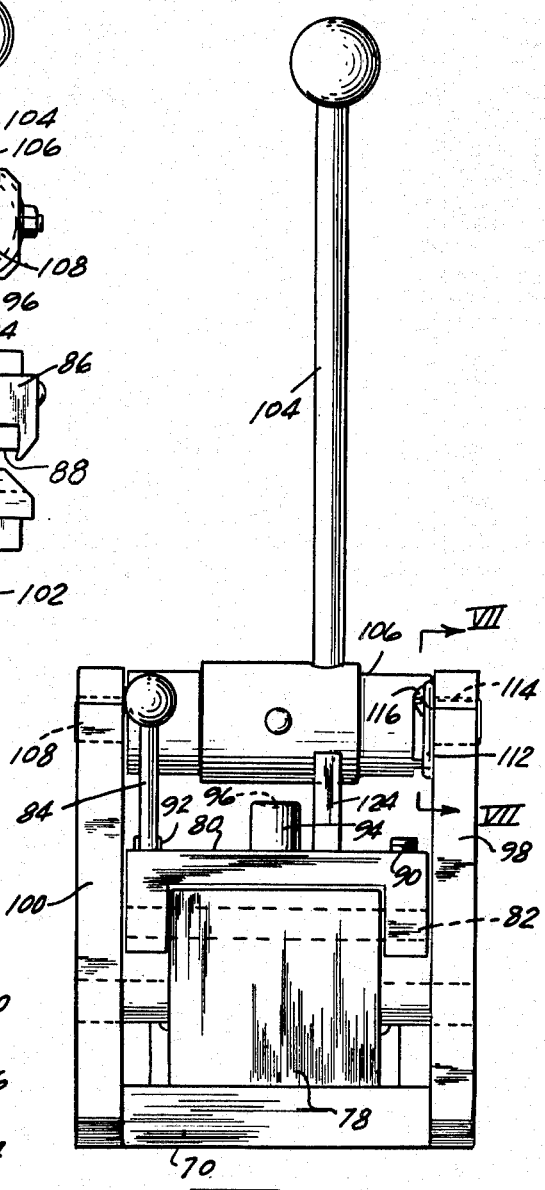
Fig. 5
Fig. 6
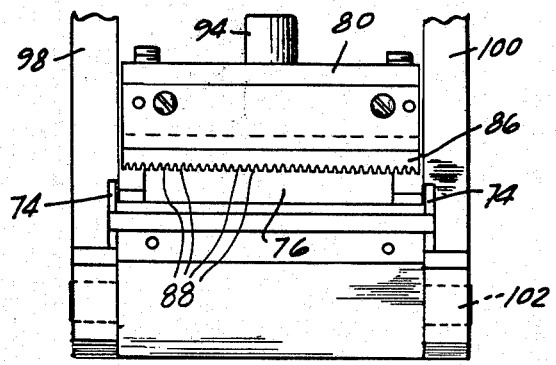
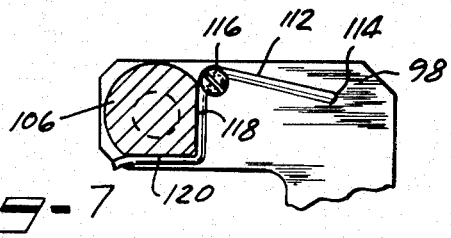
Fig. 7

TERMINATION APPARATUS FOR MAKING SOLDER-LESS ELECTRICAL CONNECTIONS TO CONNECTOR TERMINALS, IN PARTICULAR TO INSULATION-PIERCING TERMINALS

This is a continuation of application Ser. No. 407,782, filed Oct. 19, 1973, now abandoned.

BACKGROUND OF THE INVENTION

1. Field of the Invention

This invention relates to apparatus for terminating electrical conductors in respective contacts of an electrical connector, and more particularly to an improvement in a conductor soldering apparatus for quickly making solderless electrical connections between insulated electrical conductors and insulation-piercing contacts carried in separate channels of an electrical connector.

2. Description of the Prior Art

A certain type of machine, generally known in the art as a Warren machine, has found wide spread use for making solder connections between a plurality of conductors and respective electrical terminals. Machines of this type generally have a pivotally mounted conductor separating and holding apparatus which supports the conductors in a spaced relationship with respect to a pair of blades of a cutting and stripping mechanism. The cutting blade severs the conductors so that they extend the same amount from the holding apparatus and the stripping blade severs and holds the insulation for stripping as the holding apparatus is pivoted away from the cutting mechanism. The cutting mechanism is carried on a carriage mounted for movement transversely of the conductor holder and a terminal strip holder is movably mounted on the carriage for visual and manual placement of a strip of terminals adjacent respective stripped ends of the conductors as the holding apparatus is pivoted toward the carriage. The individual conductors and the corresponding terminals are then joined by soldering, the most simple process being the utilization of a seldering iron by the operator.

Good electrical and mechanical connections are effected in this manner and an experienced operator can produce banks of soldered terminals with few bridgings.

The overall termination process described above, however, has several disadvantages. First of all, bridging can occur and lead to an effective overall increase in assembly time. Secondly, soldering apparatus is necessary and a fairly high degree of skill is required for continuously soldering on a mass basis.

SUMMARY OF THE INVENTION

In view of the foregoing, it is therefore highly desirable to provide an improved version of the termination apparatus discussed above which can dispense with the deleterious results and necessary equipment and skill attendant to providing solder connections.

It is therefore a primary object of the invention to provide an improved apparatus for making solderless connections to a plurality of electrical terminals.

More specifically, an object of the present invention is to provide an improved apparatus which supports and moves a connector into automatic registry with a plurality of insulated conductors and which includes means for inserting the insulated conductors into a corresponding plurality of insulation-piercing contacts carried in separate parallel channels of the connector.

According to the invention, terminating apparatus of the type described includes a conductor supporting and separation device for supporting a plurality of insulated conductors in generally the same plane, the conductor supporting device being pivotally mounted so as to move the conductors toward and away from the path of travel of a carriage. The carriage is movable between two positions and supports a conductor cutting mechanism, when located in one position, for cutting the supported conductors so that they extend a predetermined distance from the supporting device. The carriage also carries a connector supporting and insertion mechanism which is movable with the carriage so that parallel horizontally oriented channels of the connector are moved into alignment with the individual supported conductors. The insertion mechanism is pivotally carried on the connector support mechanism and is adapted to have a force applied thereto for inserting all of the conductors into respective insulation-piercing contacts disposed in the separate conductor channels.

After insertion of the conductors on one side of the connector, the connector is removed from its support, the cutting operation is preformed again with respect to the remaining conductors associated with the other side of the connector, the connector is then remounted on the support and the remaining conductors are inserted as in the first insertion operation.

BRIEF DESCRIPTION OF THE DRAWINGS

Other objects, features and advantages of the invention, its organization, construction and operation will be best understood from the following detailed description of a preferred embodiment of the invention, taken in conjunction with the accompanying drawings, on which:

FIG. 4 is an elevational view of the connector support and conductor insertion mechanism according the present invention;

FIG. 5 is a rear view of the apparatus of FIG. 4;

FIG. 6 is a front view of the lower portion of the apparatus of FIG. 4; and

FIG. 7 is a partial sectional view taken substantially along the line VII—VII of FIG. 5;

DESCRIPTION OF THE PREFERRED EMBODIMENT

Figure 1:
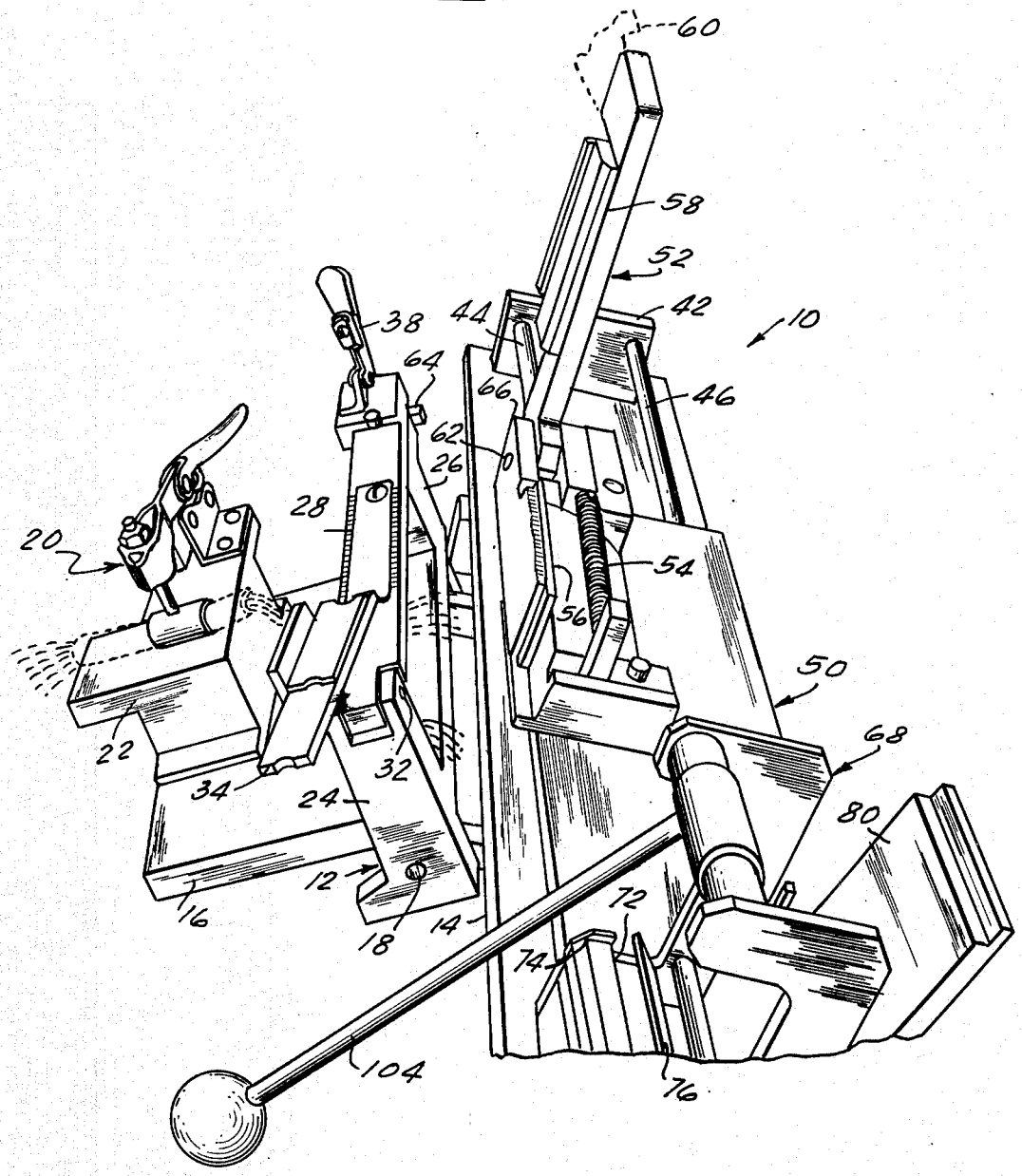
FIG. 1 is a pictorial representation of a termination apparatus constructed in accordance with the present invention shown with the conductor holder device pivoted away from the carriage.
Figure 2:
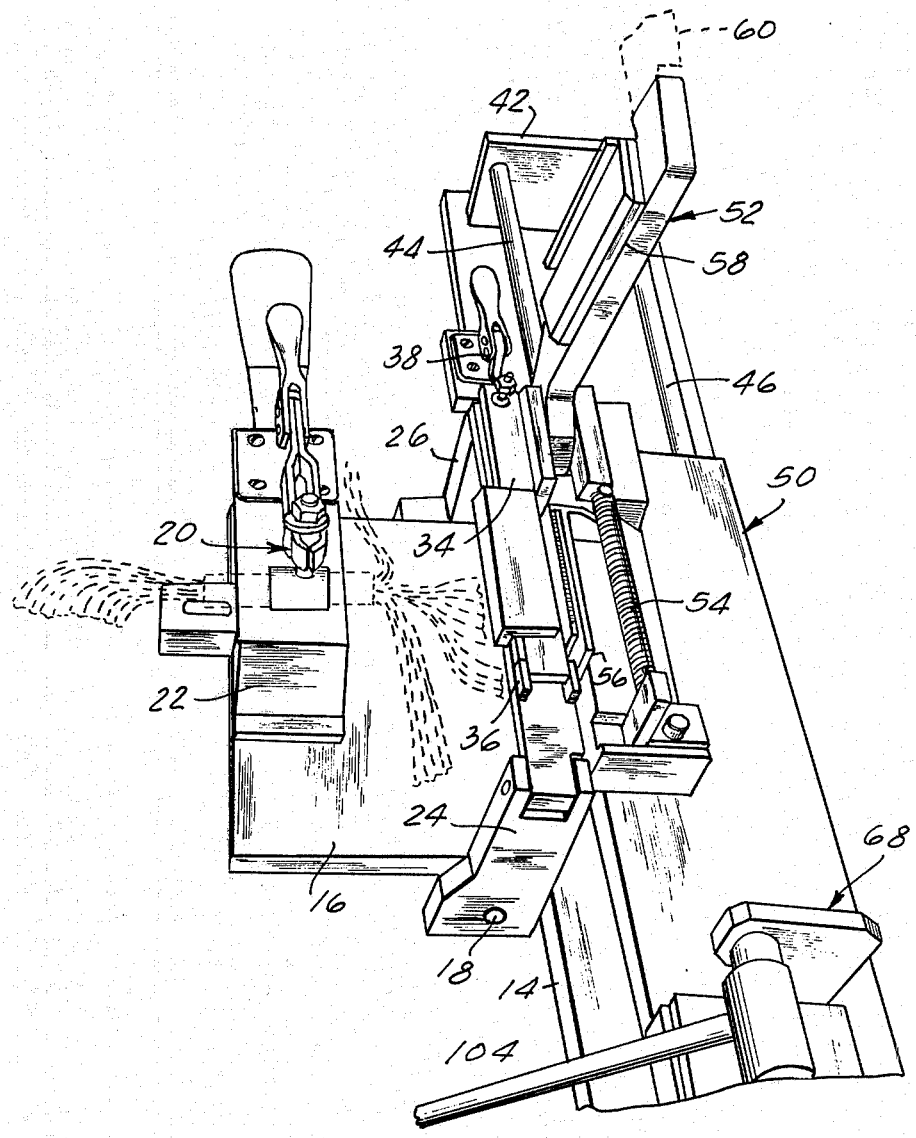
FIG. 2 is a view of the apparatus of FIG. 1 with the conductor holder device pivoted toward the carriage.
Figure 3:
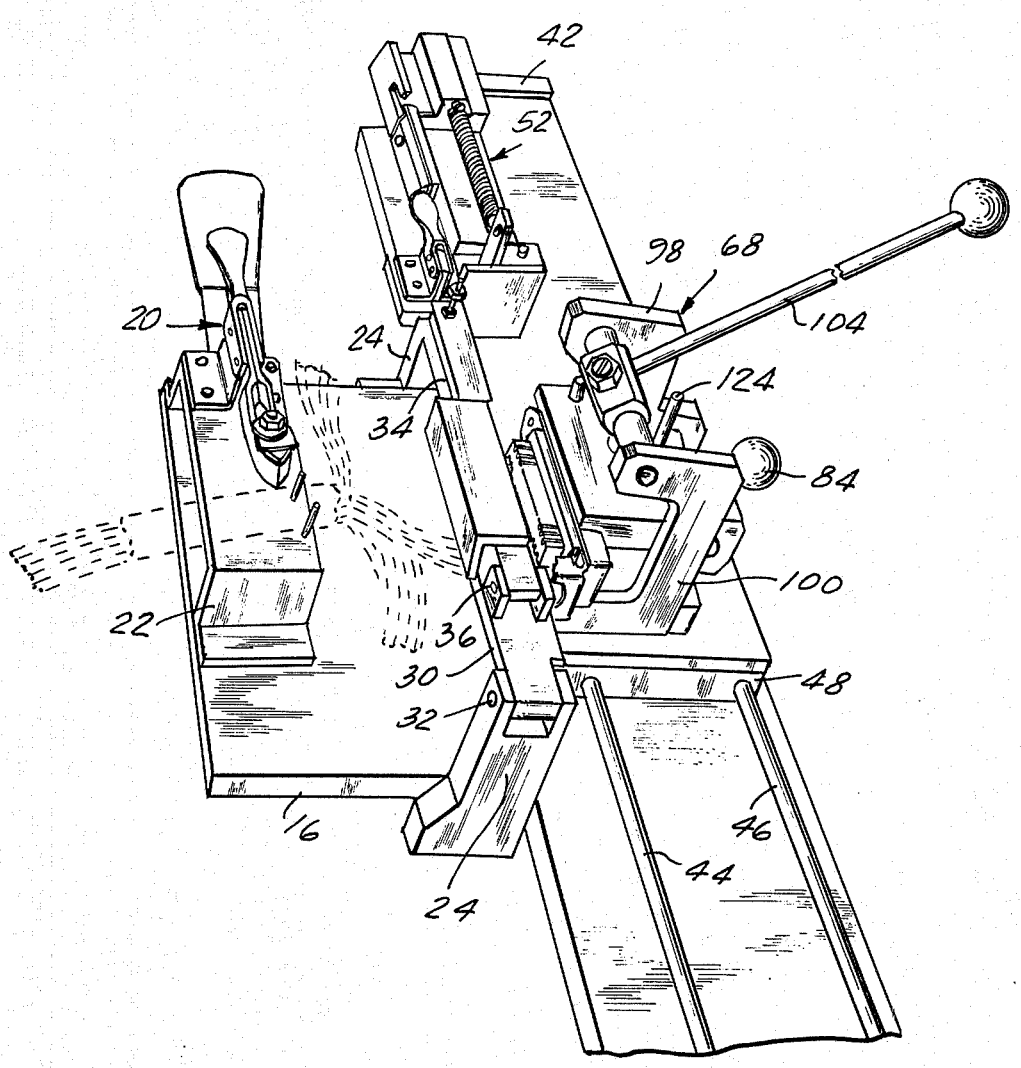
FIG. 3 is another view of the apparatus according to FIG. 1 showing the conductor holder device pivoted toward the carriage and the carriage moved to position the connector support and conductor insertion mechanism opposite the supported conductors.

Referring to FIGS. 1–3, a termination machine is generally illustrated at 10 as comprising a frame 12 having a carriage base 14 and a conductor holder base 16 pivotally mounted to the carriage base 14 at 18.

A cable clamp 20 and a mount 22 for supporting the cable above the holder base 16 is provided for clamping a multiconductor cable in the apparatus 10. The holder base 16 has a pair of upstanding arms 24 and 26 extending from the pivot 18 and supporting a conductor separation comb 28 on an arm which is pivotally mounted at 32 and which carries a clamping bar 34 which is pivotally mounted at 36 for rotation over the conductors. A latch mechanism 38 clamps the arm over the conductors to hold the conductors in an extended separated relationship.

The carriage includes a pair of upstanding end members, only the end member 42 being shown, at opposite ends of the carriage base 14. The end members, e.g. 42, serve as carriage end stops and support a pair of spaced carriage rails 44 and 46 which mount the carriage 50 on a plurality of carriage bearings 48 for movement along the carriage rails.

A cutter mechanism 52 is mounted on the carriage and has a waste spring 54 adjacent thereto for receiving and holding the waste ends of the conductors after cutting. The cutter mechanism 52 comprises a lower cutter bar 56 mounted transversely of the conductors on a mounting member 66, and a cutter bar 58 which has a handle 60 and which is pivotally mounted at 62 in operative association with the cutter bar 56. The lower cutter bar mount 66 extends in an interference relation with a limit stop 64 for the cutter which is carried by the conductor holder. It is readily apparent that the interference relationship between the mount 66 and the limit stop 64 disappears when the conductor holder is pivoted away from the carriage.

The carriage 50 also mounts an insertion mechanism 68 at a point spaced from the cutter mechanism 52 such that the insertion mechanism 68 is accurately aligned with, and accurately aligns an electrical connector supported therein with the individual conductors supported by the conductor separation comb 28. The insertion mechanism 68 includes a base plate 70 having a connector support 72 mounted thereon. The connector support 72 includes at least one projection 74 for receiving a connector in abutment therewith to align the contact channels of the connector with the supported conductors. The connector support 72 includes a shoulder 75 which is cooperable with a spaced support spring 76 to releasably clamp a connector in the insertion mechanism.

A block 78 is mounted at the rear of the base plate 70 and carries an insertion tool holder 80 which is rotatable about an axis 82. The insertion tool holder 80 also carries a handle 84 for rotating the insertion tool holder, and an insertion head 86 having a plurality of insertion blades 88 for engaging and pressing respective insulated conductors into corresponding insulation-piercing contacts disposed in separate horizontally oriented channels of the supported electrical connector. The insertion tool holder 80 further comprises a pair of spaced spring loaded pins 90 and 92 to aid in stripping the connector from the insertion head after an insertion operation.

The insertion tool holder 80 also carries a projection 94 having an arcuate cam surface 96. A pair of C-shaped arms 98 and 100 are mounted for rotation about an axis 102, in the form of a pin, and carry a handle 104 which is rotatably mounted on a cylinder 106 for rotation about an axis 108. The cylinder 106 also mounts a cam 110 which is rotatable into engagement with the cam surface 96 of the projection 94 carried by the insertion tool holder 80. Therefore, as the handle 104 is rotated toward the rear, the insertion tool holder is cammed downwardly and the insertion blades 88 of the insertion head 86 force the individual conductors through the respective connector channels and into the insulation-piercing contacts located therein.

In order to maintain the handle 104 in a semi-fixed position, an upright position in this particular embodiment, out of the way of an operator and in a noninterfering relationship with the conductor holder during movement of the carriage to position the insertion mechanism adjacent the conductor holder, the handle 104 is provided with a yieldable spring toggle mechanism. The toggle mechanism may be provided at both ends of the cylinder 106 and may advantageously take the form illustrated in FIG. 7 wherein the cylinder 106 is provided with a pair of flat surface portions 118 and 120 disposed at generally right angles with respect to each other and having a rounded portion intermediate thereto. A spring 112 has one end secured in a hole 114 and is fixed to the upstanding member by means of a screw 116. The other end of the spring 118 is shaped to complement the relative angular disposition of the flat surface portions 118 and 120 and presses against these surfaces to maintain the handle 104 in the upright position.

A pin 124 is carried on the insertion tool holder 80 in alignment with the handle 104 and serves as a limit to define the maximum depth of conductor insertion and to limit the forces applied across the connector.

In operation, the carriage is moved so as to position the cutter mechanism 52 adjacent the conductor holder. An operator then lifts the cutter bar 58 by the handle 56 to rotate the cutter bar 58 clear of the cutter bar 56 and into a generally vertical position. An operator then releases the clamp bar latch 38 and pivots the clamp bar 34 away from the conductor separation comb 28. The conductors are then dressed through the comb 28 across the cutter bar 56 and into the waste spring 54, in accordance with any desired connector termination schedule. The clamp bar 34 is then pivoted down and latched to hold the conductors in a separated parallel relationship.

Next, the operator moves the cutter bar 58 downwardly to cooperate with the cutter bar 56 and severs the conductors at equal distances from the conductor holding device. The cutter bar 58 is then pivoted upwardly to clear the cutting zone and the holding device is pivoted rearwardly to clear the held conductors from interfering with the carriage and to release the limit stop 64, 66. A connector, if not previously mounted, is mounted in the connector support 72 of the insertion mechanism 68 and the carriage is moved to the end stop whereupon the channels of the supported connector are accurately aligned with the supported conductors. The conductor holder is then pivoted forward about the axis 18 to position the aligned conductors and channels parallel and immediately adjacent each other. The insertion operation is then performed by rotating the handle 84 down as described above.

After insertion, the latch 38 is released, the clamp bar 28 is pivoted to release the terminated conductors, and the connector is removed from the insertion mechanism. The connector is then moved to the rear and suspended from the terminated conductors.

The conductor holding device is then pivoted to the rear to permit the cutter mechanism 52 to be repositioned adjacent the conductor holding device. The waste ends from the previous cut are removed from the waste spring 54 and a new set of conductors is dressed into the comb and the waste spring as previously discussed. The cutter mechanism 52 is then operated to sever these conductors, the conductor holding device is pivoted to the rear to release the carriage, the carriage is moved to reposition the insertion mechanism 68 adjacent the holding device, the connector is brought under the arm 30 and placed on the connector support upside down from the previous position on the support, the conductor holding device is pivoted forward to position the conductors adjacent respective connector channels, and the insertion mechanism 68 is again operated to terminate the conductors on the second side of the connector.

To remove the completely terminated connector from the termination apparatus, the latch 38 is released and the clamp bar is pivoted up to release the individual conductors. Next, the connector is removed from the connector support 72, the arm 30 is pivoted out of engagement with the upstanding arm, and the conductors with the attached conductor are removed over the distal end of the arm 30.

In summary, apparatus normally used for effecting solder connections has been improved to provide faster and more reliable mechanical and electrical termination of a plurality of conductors in respective insulation-piercing contacts of an electrical conductor. More specifically, the known type of apparatus has been advantageously adapted for quick, positive and accurate alignment of conductors and contacts and has been provided with means for effecting electrical connections without the necessity of wire stripping and soldering operations.

Although the invention has been described by reference to a specific illustrative embodiment thereof, many changes and modifications of the invention may become apparent to those skilled in the art without departing from the spirit and scope of the invention. It is therefore intended that the patent warranted hereon include all such changes and modifications as may reasonably and properly be included within the scope of this contribution to the art.

What is claimed is:

1. Apparatus for terminating a plurality of free-ended insulated conductors in a corresponding plurality of insulation-piercing contacts which are disposed rearwardly in an electrical connector, comprising:

conductor support means for holding the conductors to extend from said support means in a spaced relationship corresponding to the spacing of the contacts;

a carriage mounted for movement transversely of the conductors between first and second positions;

conductor cutting means carried on said carriage for cutting the conductors to extend the same distance from said support means when said carriage is in said first position; and connector support means mounted on said carriage spaced from said cutting means, including alignment means for holding the connector with the contact thereof aligned parallel and adjacent the conductors when said carriage is in said second position, and insertion means for forcing each of the conductors into the insulation-piercing contacts.

2. The apparatus of claim 1, wherein said conductor support means holds the conductors in a planar relationship and is pivotally mounted to position the conductors away from and out of obstruction with said carriage as it is moved from one of said positions to the other.

3. The apparatus of claim 1, wherein said connector support means comprises a base connected to said carriage, said alignment means includes releasably engageable means for receiving and holding the connector with the contacts generally horizontal and the rear thereof extending toward said conductor support means, said insertion means being pivotally mounted on said base for rotation toward and away from the supported connector, said insertion means including a plurality of insertion members aligned with respective contacts for engaging and pressing the conductors into the respective contacts, and a toggle mechanism for engaging said insertion means and forcing the insertion members into the contacts.

4. The apparatus of claim 3, wherein said toggle mechanism includes a rotatable handle and a projection extending to engage said insertion means, and comprising a stop member carried on said insertion means for limiting rotation of said handle and the depth of insertion.

5. The apparatus of claim 3, wherein said insertion means includes spring loaded connector ejection means for urging the connector away from said insertion tool upon rotation of said insertion tool away from said connector support means after an insertion operation.

6. The apparatus of claim 5, wherein said spring loaded ejection means comprises a pair of spaced spring loaded plungers for engaging the connector.

7. Termination apparatus for terminating a plurality of free-ended insulated conductors in a corresponding plurality of insulation-piercing contacts disposed in an electrical connector, comprising:

a base including a connector support member for receiving the connector with the contacts oriented horizontally, and means cooperable with said support member to releasably engage and hold the connector in the horizontal orientation;

an insertion tool pivotally carried on said base for rotation adjacent the supported connector, the individual conductors received between the connector and the insertion tool aligned with and parallel to the connector contacts, said insertion tool comprising a plurality of insertion members for engaging and forcing the conductors into the respective insulation-piercing contacts;

means for engaging and forcing the insertion tool toward the supported connector comprising a pair of spaced members pivotally connected to said base on respective sides of said insertion tool, a manually operable handle rotatably connected between said members and including a projection rotated toward said insertion tool, said insertion tool further comprising a shaped member for receiving and being cammed by said projection toward the supported connector; and means for limiting the movement of said insertion tool and thus limiting the depth of insertion.

8. The termination apparatus of claim 7, comprising yieldable means for holding said handle in a predetermined position.

9. The termination apparatus of claim 8, wherein said handle is carried on a shaft for rotation between said members and said yieldable means comprises means defining a pair of flat portions on said shaft disposed at an angle with respect to each other, and a spring secured to one of said members and pressing against both of said flat portions.

10. The apparatus of claim 7 wherein said insertion tool comprises at least one spring loaded projection for engagement with the connector and operable to urge the connector away from said insertion tool upon completion of an insertion operation.

11. The apparatus of claim 8, wherein said handle is carried on a shaft for rotation between said members, and said yieldable means comprises at least one flat portion on said shaft and a spring secured to one of said members and pressing against said flat portion.

12. The termination apparatus of claim 7, wherein said connector support member comprises a shoulder and a spring spaced from said shoulder to receive and releasably clamp a connector therebetween.

13. The termination apparatus of claim 7, wherein said means for limiting the movement of said insertion tool comprises a pin extending from said insertion tool in alignment with said handle to contact and limit rotation of said handle.

14. The termination tool of claim 7, wherein said spaced members are each C-shaped members and each include a pair of parallel extending legs pivotally connected to said base and rotatably connected to said handle adjacent respective ends of the C.

15. The termination apparatus of claim 7, wherein said insertion tool comprises a tool handle for rotating said tool toward and away from said connector support member to load and unload a connector.

16. The termination apparatus of claim 7, wherein said connector support member includes means for aligning the connector so that the contacts are aligned with respective insertion members of said insertion tool.

17. Apparatus for terminating a plurality of insulated conductors in a corresponding plurality of insulation-piercing contacts which are supported by an electrical connector, comprising:

conductor support means for holding the conductors to extend in a spaced relationship corresponding to the spacing of the contacts;

conductor cutting means mounted for movement toward and away from a position adjacent said conductor support means for cutting the conductors to extend the same distance from said conductor support means; and connector support means mounted for linear movement transversely of the conductors toward and away from said position adjacent said conductor support means, including alignment means for holding the connector with the contacts aligned parallel and adjacent the conductors when said connector support means is in said position, and insertion means for forcing each of the conductors into the respective insulation-piercing contacts.

18. The apparatus of claim 17, wherein said connector support means and said cutting means are fixedly connected for simultaneous movement along a path extending transversely of the conductors.

19. In an apparatus of the type ordinarily used for making solder connections between a plurality of insulated conductors and a respective plurality of contacts, wherein a conductor holder supports the conductors in a spaced apart relationship equal to the spacing of the plurality of contacts, a carriage runs transversely of the conductors for ordinarily stripping the conductors of insulation, a movable contact support is mounted on the carriage for disposition by the carriage to a point adjacent the conductors, and the conductor holder is movable transversely of the carriage for aligning the conductors and the contacts, the improvement therein for solderless termination of the conductors in insulation-piercing contacts comprising:

a cutter mounted on the carriage for cutting the conductors, without stripping the ends thereof, to extend the same distance from the conductor holder, the conductor holder including means for spacing the conductors apart distances equal to the spacing of insulation-piercing contacts of an electrical connector; and a connector support fixed on the carriage at a predetermined distance from said cutter to support the connector for automatic alignment of the conductors and the insulation-piercing contacts of the connector upon movement of the carriage to a fixed terminating position, including means for engaging and forcing the individual conductors into the insulation-piercing contacts of the connector.

20. Termination apparatus for terminating a plurality of free-ended insulated conductors in a corresponding plurality of insulation-piercing contacts disposed in an electrical connector, comprising:

a base including a connector support member for receiving the connector with the contacts oriented horizontally, and means cooperable with said support member to releasably engage and hold the connector in the horizontal orientation;

an insertion tool pivotally carried on said base for rotation adjacent the supported connector, the individual conductors received between the connector and the insertion tool aligned with and parallel to the connector contacts, said insertion tool comprising a plurality of insertion members for engaging and forcing the conductors into the respective insulation-piercing contacts;

means for engaging and forcing the insertion tool toward the supported connector comprising at least one member pivotally connected to said base, a manually operable handle rotatably connected to said member and including a projection rotated toward said insertion tool, said insertion tool further comprising a shaped member for receiving and being cammed by said projection toward the supported connector; and means for limiting the movement of said insertion tool and thus limiting the depth of insertion.

* * * * *